US007661806B2

(12) United States Patent
Missell et al.

(10) Patent No.: US 7,661,806 B2
(45) **Date of Patent: *Feb. 16, 2010**

(54) FUSIBLE REACTIVE MEDIA COMPRISING CROSSLINKER-CONTAINING LAYER

(75) Inventors: Gregory E. Missell, Penfield, NY (US); Lawrence P. DeMejo, Rochester, NY (US); Xiaoru Wang, Webster, NY (US)

(73) Assignee: Eastman Kodak Company, Rochester, NJ (US)

( * ) Notice: Subject to any disclaimer, the term of this patent is extended or adjusted under 35 U.S.C. 154(b) by 726 days.

This patent is subject to a terminal disclaimer.

(21) Appl. No.: 11/078,275

(22) Filed: Mar. 11, 2005

(65) Prior Publication Data

US 2006/0204686 A1 Sep. 14, 2006

(51) Int. Cl.
*B41J 2/01* (2006.01)
*B41M 5/00* (2006.01)
*B41M 5/40* (2006.01)

(52) U.S. Cl. ..... 347/102; 347/105; 428/32.25; 428/32.3; 428/32.34; 428/32.38

(58) Field of Classification Search ..... 428/32.1–32.38; 347/101–106; 427/333
See application file for complete search history.

(56) References Cited

U.S. PATENT DOCUMENTS

| | | | | |
|---|---|---|---|---|
| 3,758,629 | A * | 9/1973 | Thill | 525/329.9 |
| 4,844,959 | A * | 7/1989 | Read et al. | 428/34.9 |
| 4,869,960 | A * | 9/1989 | Gibb et al. | 428/405 |
| 4,879,148 | A * | 11/1989 | Neaves et al. | 428/41.8 |
| 5,073,448 | A * | 12/1991 | Vieira et al. | 428/32.1 |
| 5,141,797 | A * | 8/1992 | Wheeler | 428/195.1 |
| 5,955,251 | A * | 9/1999 | Koyama et al. | 430/532 |
| 6,120,199 | A * | 9/2000 | Takekoshi | 400/611 |
| 6,357,871 | B1 | 3/2002 | Ashida et al. | |
| 6,436,617 | B1 | 8/2002 | Wang et al. | |
| 6,464,351 | B1 * | 10/2002 | Landry-Coltrain et al. | 347/105 |
| 6,481,843 | B1 * | 11/2002 | Landry-Coltrain et al. | 347/105 |
| 6,497,480 | B1 | 12/2002 | Wexler | |
| 6,534,156 | B1 * | 3/2003 | Baker et al. | 428/195.1 |
| 6,548,182 | B1 | 4/2003 | Field et al. | |
| 6,789,891 | B2 * | 9/2004 | Wang et al. | 347/105 |
| 6,814,437 | B2 * | 11/2004 | Wexler | 347/105 |
| 6,866,384 | B2 * | 3/2005 | O'Connor et al. | 347/105 |
| 6,869,178 | B2 * | 3/2005 | Yau et al. | 347/105 |
| 7,198,363 | B2 * | 4/2007 | Wexler | 347/105 |
| 2003/0112310 | A1 * | 6/2003 | Wang et al. | 347/105 |
| 2004/0061762 | A1 * | 4/2004 | Wexler | 347/105 |
| 2004/0061764 | A1 * | 4/2004 | O'Connor et al. | 347/105 |
| 2004/0090512 | A1 * | 5/2004 | Yau et al. | 347/105 |
| 2005/0025911 | A1 * | 2/2005 | Kasperchik et al. | 428/32.1 |
| 2006/0003112 | A1 * | 1/2006 | DeMejo et al. | 428/32.24 |
| 2006/0003115 | A1 * | 1/2006 | DeMejo et al. | 428/32.34 |
| 2006/0204684 | A1 * | 9/2006 | Missell et al. | 428/32.34 |
| 2006/0204685 | A1 * | 9/2006 | Missell et al. | 428/32.34 |

FOREIGN PATENT DOCUMENTS

| | | |
|---|---|---|
| EP | 0 320 594 A2 | 6/1989 |
| EP | 1 293 356 | 3/2003 |

OTHER PUBLICATIONS

Brandrup, J.; Immergut, Edmund H.; Grulke, Eric A.; Abe, Akihiro; Bloch, Daniel R. Polymer Handbook (4th Edition). 1999 (pp. VI/198). John Wiley & Sons. Online version available at: http://knovel.com/web/portal/browse/display?_EXT_KNOVEL_DISPLAY_bookid=1163&VerticalID=0.*

* cited by examiner

*Primary Examiner*—Mark Ruthkosky
*Assistant Examiner*—Gerard T Higgins
(74) *Attorney, Agent, or Firm*—Chris P. Konkol; Arthur E. Kluegel; Andrew J. Anderson

(57) ABSTRACT

An inkjet recording element comprising a support having thereon in order, from top to bottom, an upper fusible, porous layer comprising fusible polymeric particles, which particles comprise a thermoplastic polymer with reactive functional groups, the inkjet recording element further comprising a lower crosslinker-containing layer in which a polyfunctional compound has complementary reactive functional groups capable of crosslinking the reactive functional groups on the thermoplastic polymer under fusing. Optionally, an ink-carrier-liquid receptive layer is present between the fusible, porous layer and the support. Also disclosed is a method of inkjet printing on the element.

21 Claims, No Drawings

FUSIBLE REACTIVE MEDIA COMPRISING CROSSLINKER-CONTAINING LAYER

CROSS-REFERENCE TO RELATED APPLICATIONS

The present application is related to U.S. application Ser. No. 11/078,229 by WANG et al. and entitled, "MULTI-FUNCTIONAL POLYMER PARTICLES AND METHODS OF MAKING THE SAME," U.S. application Ser. No. 11/077,614 by Missell et al. and entitled, "FUSIBLE REACTIVE MEDIA" and U.S. application Ser. No. 11/078,274 by Missell et al. and entitled, "INKJET MEDIA COMPRISING MIXTURE OF FUSIBLE REACTIVE POLYMER PARTICLES," all filed concurrently herewith.

FIELD OF THE INVENTION

The present invention relates to an inkjet recording element and a printing method using the element. More specifically, the invention relates to a recording element in which the top layer comprises thermoplastic polymer particles having reactive functional groups and a lower cross-linker-containing layer comprises a polyfunctional compound having complementary reactive functionalities that can crosslink the reactive functionalities on the thermoplastic polymer particles when the layer is fused.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof at least one ink-receiving layer. The ink-receiving layer is typically either a porous layer that imbibes the ink via capillary action or a polymer layer that swells to absorb the ink. Transparent swellable hydrophilic polymer layers do not scatter light and therefore afford optimal image density and gamut, but may take an undesirably long time to dry. Porous ink-receiving layers are usually composed of inorganic or organic particles bonded together by a binder. During the inkjet printing process, ink droplets are rapidly absorbed into the coating through capillary action, and the image is dry-to-touch right after it comes out of the printer. Therefore, porous coatings allow a fast "drying" of the ink and produce a smear-resistant image; however, porous layers, by virtue of the large number of air-particle interfaces, scatter light that may result in lower densities of printed images.

Furthermore, inkjet prints prepared by printing onto inkjet recording elements are subject to environmental degradation. They are especially vulnerable to damage resulting from contact with water and atmospheric gases such as ozone. Ozone can bleach inkjet dyes resulting in loss of density. Porous layers are particularly vulnerable to atmospheric gases in view of the open pores. The damage resulting from the post-imaging contact with water can take the form of water spots resulting from deglossing of the top coat, dye smearing due to unwanted dye diffusion, and even gross dissolution of the image recording layer. To overcome these deficiencies, inkjet prints are often laminated. However, lamination is expensive, requiring a separate roll of material.

Efforts have been made to avoid lamination and yet provide protected inkjet prints by providing an inkjet receiver having an uppermost fusible, porous layer. Such inkjet elements are known in the art. Fusing the upper layer after printing the image has the advantage of both providing a protective overcoat for water and stain resistance and reducing light scatter for improved image quality.

For example, U.S. Pat. Nos. 4,785,313 and 4,832,984 relate to an inkjet recording element comprising a support having thereon an upper fusible, porous ink-transporting layer and a lower swellable polymeric ink-retaining layer, wherein the ink-retaining layer is non-porous.

EP 858905A1 relates to an inkjet recording element having a fusible porous ink-transporting outermost layer, formed by heat sintering thermoplastic particles, and an underlying porous ink-retaining layer to absorb and retain the ink applied to the outermost layer to form an image. The underlying porous ink-retaining layer is constituted mainly of refractory pigments. After imaging, the outermost layer is made non-porous.

EP 1,188,573 A2 relates to an inkjet recording material comprising in order: a sheet-like paper substrate, at least one pigment layer coated thereon, and at least one sealing layer coated thereon. Also disclosed is an optional dye-trapping layer present between the pigment layer and the sealing layer.

U.S. Pat. No. 6,497,480 to Wexler discloses inkjet media comprising both a fusible ink-transporting layer and a fusible dye-trapping layer. A base layer under the fusible layers may be employed to absorb ink-carrier-liquid fluid.

Protective overcoats and crosslinked overcoats for imaging elements are also known in the art. For example, U.S. Pat. No. 6,436,617 relates to protective overcoats, for photographic image elements, comprising water-dispersible latex particles, which particles comprise an epoxy material and a thermoplastic acid polymer, a water-soluble hydrophilic polymer, and a hydrophobically modified associative thickener. The hydrophilic polymer is substantially washed out during photographic processing facilitating the coalescence of the other materials. Another driving force for this coalescence is the elevated temperature during the drying associated with photoprocessing.

U.S. Pat. No. 6,548,182 relates to an inkjet recording material wherein a coating comprises a water-soluble polymer having a plurality of carboxyl groups in combination with a water-soluble oxazoline compound as a crosslinking agent. EP 0 320 594 A2 discloses aqueous crosslinkable resin dispersions for use in fusible inkjet media, however, in which polymeric particles react with an emulsifier compound.

Commonly assigned U.S. Ser. No. 10/881,127 discloses an inkjet recording element comprising a support having thereon in order from the top:

(a) a fusible, porous pigment-trapping layer comprising (i) fusible polymer particles comprising a thermoplastic polymer with reactive functional groups, (ii) a polyfunctional compound having complementary reactive functional groups capable of crosslinking the reactive functional groups on the thermoplastic polymer, and (iii) an optional binder; and (b) an optional ink-carrier-liquid receptive layer. The support may also function as a liquid-absorbing sump layer either alone or in combination with the optional ink-carrier-liquid receptive layer.

Similarly, commonly assigned U.S. Ser. No. 10/881,264 discloses an inkjet recording element comprising a support having thereon, in order from the top:

(a) a fusible, porous ink-transporting layer comprising (i) fusible polymer particles comprising a thermoplastic polymer with reactive functional groups, (ii) a polyfunctional compound having complementary reactive functional groups capable of crosslinking the reactive functional groups on the thermoplastic polymer, and (iii) an optional binder;

(b) a fusible dye-trapping layer comprising fusible polymer particles, a dye mordant, and an optional hydrophilic binder; and (c) an optional an ink carrier liquid receptive layer.

It is an object of this invention to provide an improved inkjet recording element comprising an upper porous layer that can be fused after printing, thereby obtaining high-density images. It is another object of the invention to provide an improved inkjet recording element having a protective upper porous layer that can be fused after printing to render images resistant to water and stain.

SUMMARY OF THE INVENTION

These and other objects are achieved in accordance with the invention that comprises an inkjet recording element comprising a support having thereon in order:

a) an upper fusible, porous layer comprising fusible reactive polymer particles comprising a thermoplastic polymer with reactive functional groups and an optional binder;

b) a lower (non-porous or porous) crosslinking layer, preferably adjacent to the upper fusible, porous layer, the lower crosslinking layer comprising a polyfunctional compound having complementary reactive functional groups capable of crosslinking the reactive functional groups on the thermoplastic polymer in the upper fusible porous layer, and optionally a binder; and c) an optional lower porous layer that is fusible or non-fusible and that is receptive to ink-carrier liquid, which may optionally comprise a mordant.

Preferably, the lower (non-porous or porous) crosslinking layer is adjacent to the upper fusible, porous layer, the lower crosslinking layer. The crosslinking agent in the lower crosslinking layer must be in reactive association with the fusible reactive polymer beads and, therefore, must be able to diffuse into the upper fusible, porous layer.

The support may optionally function as a liquid-absorbing or sump layer either alone or in combination with the optional lower porous layer. This inkjet recording element includes that intended for use with dye-based inks, pigment-based inks, or both. In the case of printing with dye-based inks, the inkjet recording element may be designed for the lower porous layer to preferably function as a primary dye-trapping layer separate from the upper fusible, porous layer. In the case of printing with pigment-based inks, the inkjet recording element may be designed either without a lower porous layer or for the lower porous layer to preferably function as a sump layer; however, it is also possible for the upper fusible, porous layer to function as either a dye-trapping or a pigment-trapping layer, depending on the ink composition used for printing, with the optional lower porous layer functioning as a sump layer.

In a first embodiment, the upper fusible, porous layer is designed to preferably function as a pigment-trapping upper layer.

In a second embodiment, the upper fusible, porous layer is designed to preferably alternatively function as both a pigment-trapping layer and a dye-trapping layer, i.e., the printed image is formed in the upper fusible, porous layer irrespective of the ink composition.

In yet a third embodiment, the upper fusible, porous layer is designed to preferably function as an ink-receptive layer and, below the upper fusible, porous layer, there is a lower fusible, porous dye-trapping layer comprising fusible polymer particles (not necessarily crosslinkable), an optional dye mordant, and an optional hydrophilic binder. Also, optionally, an ink-carrier-liquid receptive layer is below the lower fusible, porous dye-trapping layer.

In this third embodiment, the dye-trapping layer and/or the support may optionally function as a liquid-absorbing sump layer to some extent, either alone or in combination with the optional ink-carrier-liquid receptive layer.

Also, in this third embodiment, the upper fusible, porous layer may optionally comprise a hydrophobic polymeric binder to promote the transfer of a portion or all of the aqueous ink, including dye to a lower layer comprising more hydrophilic materials. Thus, the colorant in the ink can be distributed between two fusible layers or, alternatively, substantially all of the ink colorant can be transported to the lower fusible, porous dye-trapping layer, in which case the upper fusible, porous layer may be referred to as an ink-transporting layer.

Although the first and third embodiments described above involve recording elements designed preferably for printing with either pigment-based inks or dye-based inks, it is also possible to print with either type of inks. For example, the ink-transporting layer in the second embodiment can also function as a pigment-trapping layer, or the pigment-trapping layer can also function as a dye-trapping layer. Also, as in the second embodiment, it is possible to design a "universal" recording element intended for use irrespective of whether pigment or dye-based inks are employed. In a preferred embodiment of such a universal recording element, there is no separate dye-trapping layer under the upper fusible, porous layer and, accordingly, only one fusible layer.

In a preferred embodiment of the invention, the fusible reactive polymer particles are substantially spherical and monodisperse. Monodisperse particles may be advantageous for controlling fluid absorption and can be used to improve dry time. On the other hand, monodispersed particles may be more difficult to make.

The UPA monodispersity ("Dp"), which is defined as the weight average molecular weight divided by the number average molecular weight of the polymers in the bead, is preferably less than 1.5, more preferably less than 1.3, most preferably less than 1.1, as measured by a Microtrac® Ultra Fine Particle Analyzer (Leeds and Northrup) at a 50% median value. This is another way of saying that the particle size distribution is relatively narrow which, in combination with the particle (or "bead") size, is important for the desired capillary action.

By use of the invention, an inkjet recording element is obtained that when printed with inkjet ink, and subsequently fused, has improved water resistance and stain resistance and high print density Inkjet media made in accordance with the present invention may exhibit additional advantageous properties. In some cases, the crosslinking reaction may improve gloss durability. Another potential advantage is that the invention allows the use of lower Tg polymers in the fusible particles, which in turn allows relatively lower fusing temperatures.

Still another potential advantage is that, since the fusible reactive polymer particles in the inkjet recording element each comprise a thermoplastic polymer that is later crosslinked during fusing, such polymer particles can start (exist before fusing) at a lower Tg than prior-art polymer particles that are not later crosslinked. After fusing, the Tg of the reactive polymer particles can then increase due to the crosslinking, for example, from 50° C. to 100° C. Thus, in one embodiment, the Tg of the polymer particles in unprinted inkjet media can be set below the blocking temperature, in order to facilitate fusing and then, after fusing, the Tg will have increased in order to gain the desired anti-blocking properties. This will be discussed further below.

Another embodiment of the invention relates to an inkjet printing method comprising the steps of: A) providing an inkjet printer that is responsive to digital data signals; B) loading the inkjet printer with the inkjet recording element described above; C) loading the inkjet printer with an inkjet ink composition; D) printing on the herein-described inkjet recording element using the inkjet ink composition in response to the digital data signals; and E) fusing at least the uppermost pigment-trapping layer. In a preferred embodiment, only the uppermost fusible layer is fused.

The term "porous layer" is used herein to define a layer that absorbs applied ink by means of capillary action rather than liquid diffusion. Porosity can be affected by the particle to binder geometry. The porosity of a mixture may be predicted based on the critical pigment volume concentration (CPVC).

As used herein, the terms "over," "above," "upper," "under," "below," "lower," and the like, with respect to layers in the inkjet media, refer to the order of the layers over the support, but do not necessarily indicate that the layers are immediately adjacent or that there are no intermediate layers.

In regard to the present method, the term "pigment-trapping layer" is used herein to define, in use, the layer in which most (more than 50% by weight), preferably at least about 75% by weight, more preferably substantially all, of the pigment colorant in the applied inkjet ink remains.

The term "dye-trapping layer," which can be applied to one or more adjacent layers, is used herein to define a layer that contributes substantially to the density of the applied image. Preferably, there are one or two dye-trapping layers. Preferably, the dye-trapping layer or layers, in use, provide in total greater than 50%, more preferably at least about 75% of the density and, most preferably substantially all, of the density of the image provided by the dye colorant in the printed inkjet ink. This density corresponds to the amount of colorant retained in the dye-trapping layer or layers.

In regard to the present method, the term "image-receiving layer" is intended to define one or more layers that are used as a pigment-trapping layer, dye-trapping layer, or dye-and-pigment-trapping layer.

In regard to the present method, the term "ink-carrier-liquid receptive layer" (sometimes also referred to as a "sump layer" or "base layer") is used herein to mean a layer under the one or more image-receiving layers that absorbs a substantial amount of ink-carrier liquid. In use, a substantial amount, preferably most, of the carrier fluid for the ink is received in the ink-carrier-liquid layer or layers, but wherein the layer is not above an image-containing layer and is not itself an image-containing layer (a pigment-trapping layer or dye-trapping layer). Preferably, there is a single ink-carrier-liquid receptive layer.

The term "ink-receptive layer" or "ink-retaining layer" includes all layers that are receptive to an applied ink composition, that absorb or trap any part of the one or more ink compositions used to form the image in the inkjet recording element, including the ink-carrier fluid and/or the colorant. An ink-receptive layer, therefore, can include either an image receiving layer, in which the image is formed by a dye and/or pigment, or an ink-carrier-liquid receptive layer in which the carrier liquid in the ink composition is absorbed upon application, although later removed by drying. Typically, all layers above the support are ink-receptive and the support may or may not be ink-receptive.

The term "thermoplastic polymer" is used herein to define the polymer flows upon application of heat, typically prior to any extensive crosslinking.

DETAILED DESCRIPTION OF THE INVENTION

The fusible reactive polymer particles employed in the upper fusible, porous layer of the invention may have a particle size conducive to forming a porous layer. In a particularly preferred embodiment of the invention, the average particle size of the fusible polymer particles suitably ranges from about 5 to about 10,000 nm, and the monodispersity of the particles (Dp) is less than 1.5, preferably less than 1.3, more preferably less than 1.1. Preferably, the fusible reactive polymer particles in said fusible, porous top layer range in average size from about 50 to 5,000 nm, more preferably 0.1 to about 2 μm, most preferably 0.2 to 1 μm.

As indicated above, the upper fusible, porous layer can be optionally be used as a pigment-trapping layer, an ink-transporting layer, or dye-and-pigment-trapping layer.

Upon fusing of the fusible reactive polymer particles, the air-particle interfaces present in the original porous structure of the layer are substantially eliminated and a non-scattering, substantially continuous, protective overcoat forms over the image. In a preferred embodiment of the invention, the fusible reactive polymer particles in the upper fusible, porous layer comprise a cellulose ester polymer, such as cellulose acetate butyrate, a step growth polymer, such as a polyester or a polyurethane or an chain growth polymer, for example, a styrenic polymer, a vinyl polymer, an ethylene-vinyl chloride copolymer, a polyacrylate, poly(vinyl acetate), poly(vinylidene chloride), and/or a vinyl acetate-vinyl chloride copolymer. In a preferred embodiment of the invention, the fusible reactive polymer particles are comprised of a polyacrylate polymer or copolymer (for example, acrylic beads) comprising one or more monomeric units derived from an alkyl acrylate or alkyl methacrylate monomer, wherein the alkyl group preferably has 1 to 6 carbon atoms.

As indicated above, the fusible reactive polymer particles in the upper fusible, porous layer comprise a polymer having reactive functional groups which are reactive with a crosslinking a lower (non-porous or porous) crosslinking layer. The number average molecular weight of the polymer can range from 5,000 to 1,000,000, and the glass transition temperature thereof preferably ranges from −50° C to 120° C. Preferably the Tg of the reactive polymer particles is above about 20° C and less than about 100° C., more preferably above 50° C. and below 90° C and most preferably below 80° C. The reactive polymer may be linear or branched, and the functional groups may be on the backbone chain or, for example in the case of a branched polymer, on side chains of the reactive polymer molecules.

The reactive polymer particles may be the reaction products of a mixture of (different types of) monomers comprising one or more non-reactive monomers and at least one reactive functional monomer, wherein the reactive functional monomer comprises a crosslinking-functional group that can react, in a crosslinking reaction, with a complementary crosslinking-functional group on a polyfunctional compound in a (separately coated) layer not having the fusible reactive polymer particles. Thus, first reactive functionalities on a first reactive functional monomeric unit in each of a first group of reactive polymer particles will complementarily react with second reactive functionalities on a second reactive functional unit in a polyfunctional compound, in an inter-molecular crosslinking reaction. Such reactive functional monomers may include monomers containing one or more of the following groups: cyanate, oxazoline, epoxy, acid, anhydrides, acid chlorides, hydroxyl, phenol, acetoacetoxy, thiol and/or amine functionalities, and the like.

Optionally, the upper fusible, porous layer may also comprise a mixture of various different particles. For example, the upper fusible, porous layer may comprise mixtures of (different) monofunctional polymer particles (wherein "monofunctional" refers to a single type of reactive functionality although present at a plurality of sites in a particle), but may also optionally include, in the mixture, multifunctional polymer particles or non-functional particles. Such multifunctional polymer particles are disclosed in copending U.S. application Ser. No. 11/077,614, herein incorporated by reference in its entirety. Nevertheless, the fusible reactive polymer particles reactive with the polyfunctional compound in another layer are present in at least a substantial amount by weight in the upper fusible porous layer. Preferably most, more preferably substantially all, most preferably all, by weight, of the particles in the upper fusible, porous layer comprise fusible reactive polymer particles each having reaction functionality complementary to the polyfunctional compound in an adjacent layer.

Preferably the reactive polymer particles may comprise 0.1 to 50 mole percent of reactive monomeric units, more preferably 1 to 50 mole percent, most preferably less than 30 mole percent. Too much crosslinking can result in undesirable brittleness. The reactive polymer particles may comprise 50 to 99.9 mole percent of non-reactive monomeric units.

Preferably the polyfunctional compounds in the lower (non-porous or porous) crosslinking layer comprise 0.1 to 100 mole percent of complementary reactive monomeric units, more preferably 1 to 50 mole percent. The polyfunctional compounds may comprise 0 to 99.9 mole percent of non-reactive monomeric units.

The "functional group equivalent weight" (also referred to as the weight per functional group equivalent) is defined as the grams of solid containing one gram-equivalent of functional group ("g/equivalent"). The g/equivalent ratio of the functional groups on the polymer particles to the complementary reactive functional groups on the polyfunctional compound in the inkjet recording element of the invention ranges from 1.0/0.1 to 0.1/1.0 and more preferably from 1.0/0.5 to 0.5/1.0.

The functional group equivalent weight of the polyfunctional compound is about 50 to 10,000, preferably from about 100 to 5,000, most preferably from about 100 to 2,000.

As indicated above, the reactive polymer particles and the polyfunctional compound comprise complementary reactive functional groups. For example, an epoxy-polyfunctional compound can be a copolymer based on epichlorohydrin containing epoxy monomeric units which will react with amine, carboxylic acidic, hydroxyl, thio, anhydride or the like reactive functionalities in the polymeric particles (or vice versa). Similarly, an oxazoline group in a reactive polymer particle will complementarily react with various protic-functional monomers in the polyfunctional polymer.

Preferred examples of oxazoline-polyfunctional compounds comprise monomeric units derived from monomers such as 2-vinyl-2-oxazoline and 2-isopropenyl-2-oxazoline. Examples of polyfunctional compounds with protic-type reactive functionalities include oligomers derived from acid-functional monomers such as methacrylic acid or hydroxy-functional monomers such as hydroxyalkyl (meth)acrylates, for example, hydroxyethyl (meth)acrylate.

In general, epoxy-functional reactive groups in the polyfunctional compound can react with carboxylic (—COOH), anhydride, hydroxyl (—OH), primary amine (—$NH_2$) groups or thiol groups (—SH) in the polymer particles (or vice versa), for example, polymer particles made from polymers comprising monomeric units derived from methacrylic acid (MAA), hydroxyalkylmethacrylates such as hydroxyethylmethacrylate (HEMA), or aminoalkyl methacrylates such as aminopropylmethacrylate, all common and commercially available monomers. In the case of alcohols, a catalyst such as 4-dimethylaminopyridine may be used to speed the reaction, as will be understood by the skilled chemist.

In another embodiment, oxazoline functional groups in a polyfunctional compound can similarly react with carboxylic acids, anhydrides, amines, phenols and thiols in the polymer particles (or vice versa). In a preferred embodiment of the invention, a polyfunctional compound containing repeat units having at least one ring-opening group, an epoxide or an oxazoline, reacts with polymer particles containing repeat units having a protic group, such as a carboxylic acid containing monomer. Included among useful protic reactive monomers are acrylic, methacrylic, itaconic, crotonic, fumaric and maleic acids, and anhydrides thereof.

Suitable copolymerizable monomers for making the polymeric particles and/or the polyfunctional compound include conventional vinyl monomers such as acrylates and methacrylates of the general formula:

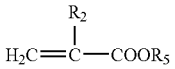

where $R_2$ is a hydrogen or alkyl, preferably methyl, and $R_5$ is a straight chain or branched aliphatic, cycloaliphatic or aromatic group having up to 20 carbon atoms which is unsubstituted or substituted. Useful or suitable copolymerizable monomers include, for example: methyl, ethyl, propyl, isopropyl, butyl, ethoxyethyl, methoxyethyl, ethoxypropylphenyl, benzyl, cyclohexyl, hexafluoroisopropyl, or n-octyl-acrylates and -methacrylates, as well as, for example, styrene, alpha-methylstyrene, 1-hexene, vinyl chloride, etc.

In a preferred embodiment of this invention, the polymer particles are synthesized in a manner known per se from the corresponding monomers by an emulsion polymerization reaction customary to the person skilled in the art. Emulsion polymerization initiators for the polymer particles include water-soluble initiators capable of generating ion radicals (such as potassium or ammonium persulfate) or free-radical-generating polymerization initiators of the type illustrated by acetyl peroxide, lauroyl peroxide, decanoyl peroxide, caprylyl peroxide, benzoyl peroxide, tertiary butyl peroxypivalate, sodium percarbonate, tertiary butyl peroctoate, and azobisisobutyronitrile (AIBN). Ultraviolet free-radical initiators illustrated by diethoxyacetophenone can also be used. Additionally, a polymer can be formed by: (1) mixing the monomers together; (2) adding a polymerization initiator; and (3) subjecting the monomer/initiator mixture to a source of ultraviolet or actinic radiation and/or elevated temperature and polymerizing the mixture. This polymer can then be dissolved in an appropriate solvent and the resulting solution dispersed in water with appropriate dispersing agents and sheared in a homogenizer to generate a crude emulsion. Rotary evaporation, at a temperature and vacuum condition appropriate for efficient removal of the solvent, yields a dispersion of polymer particles in water. Other methods for generating aqueous dispersions of polymer particles for use in the invention can also be invoked.

In one embodiment of the present invention, the polyfunctional compound has an oxazoline group represented by the following formula:

(I)

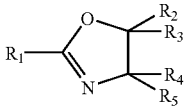

wherein $R_1$ through $R_5$ are selected so to provide a branched or unbranched vinyl oxazoline compound, for example, by selecting $R_1$ in (I) to be a branched or unbranched vinyl group according to formula (II):

(II)

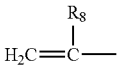

wherein $R_8$ is selected from the group consisting of hydrogen, a branched or linear $C_1$-$C_{20}$ alkyl moiety, a $C_3$-$C_{20}$ cycloalkyl moiety, a $C_6$-$C_{20}$ aryl moiety, and a $C_7$-$C_{20}$ alkylaryl moiety. If $R_1$ is such a vinyl group, $R_2$ to $R_5$ are the same or different and are selected from hydrogen, a branched or linear $C_1$-$C_{20}$ alkyl moiety, a $C_3$-$C_{20}$ cycloalkyl moiety, a $C_6$-$C_{20}$ aryl moiety and a $C_7$-$C_{20}$ alkyaryl moiety.

An oxazoline-functional unit, derived from the monomer, will provide a polymer with a moiety that is reactive to complementary reactive functionalities such as —COOH, —NH, —SH and —OH (or vice versa). A detailed discussion on the preparation of oxazoline compounds can be found in Brenton et al., "Preparation of Functionalized Oxazolines," *Synthetic Communications,* 22(17), 2543-2554 (1992); Wiley et al., "The Chemistry of Oxazolines," *Chemical Reviews,* v44, 447-476 (1949); and Frump, John A., "Oxazolines, Their Preparation, Reactions, and Applications," *Chemical Reviews,* v71, 483-505 (1971), the disclosures of which are incorporated by reference.

Examples of a polyfunctional compound having an oxazoline group include polymers containing an oxazoline group as obtained by homopolymerizing an addition-polymerizable oxazoline monomer or copolymerizing said monomer with a monomer copolymerizable therewith. Examples of the addition-polymerizable oxazoline include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-4-ethyl-2-oxazoline, 2-isopropenyl-5-methyl-2-oxazoline, 2-isopropenyl-5-ethyl-2-oxazoline, and 2-isopropenyl-4,5-dimethyl-2-oxazoline. These may be used either alone respectively or in combinations with each other. The monomer 2-isopropenyl -2oxazoline, for example, a non-limiting example of a vinyl oxazoline, is represented by the following structure:

(III)

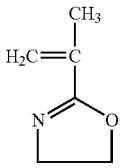

In another embodiment of the invention, a ring-opening reactive group in a polyfunctional compound is provided by an epoxy-functional polymer. The preferred epoxy-polyfunctional compound is based on an oxirane-containing monomer such as epichlorohydrin, glycidyl methacrylate, allyl glycidyl ether, 4-vinyl -1-cyclohexene-1,2-epoxide, and the like, although other epoxy-containing monomers may be used. Commercially available examples of the epoxy-polyfunctional compound are the phenol, 4,4'-(1-methylethylidene) bis-, polymer with (chloromethyl)oxirane available from Crompton Corporation, Middlebury, Conn., under the trademark WITCOBOND XW and the 2,2-bis(p-glycidyloxyphenyl)propane condensation product with 2,2-bis(p-hydroxyphenyl)propane and similar isomers available from Shell Corporation, Houston, Tex., under the trademark EPON 1001F. Blended mixtures of epoxy oligomers or polymers with other oligomers or polymers can also be utilized such as the commercially available polyhydroxyalcan polyglycidylether mixture available from Esprix Technologies, Sarasota, Fla., under the trademark CR-5L.

The fusible reactive polymer particles are intended to flow and crosslink when fused, for example, in a heated fuser nip, thereby achieving inkjet surface coatings and media with excellent image quality and print durability performance.

The particle-to-binder ratio of the particles and optional binder employed in the upper fusible, porous layer can range between about 100:0 and 60:40, preferably between about 100:0 and about 90:10. In general, a layer having particle-to-binder ratios outside the range stated will usually not be sufficiently porous to provide good image quality.

The upper fusible, porous ink-trapping layer is usually present in an amount from about 1 $g/m^2$ to about 50 $g/m^2$. In a preferred embodiment, the fusible, porous layer is present in an amount from about 1 $g/m^2$ to about 10 $g/m^2$.

Upon fusing, via the application of heat and/or pressure, the air-particle interfaces present in the original porous structure of the layer are eliminated, and a non-scattering, substantially continuous layer forms which contains the printed image. It is an important feature of the invention that the fusible, porous layer be transformable into a non-scattering layer as this significantly raises image density.

The optional porous ink-carrier-liquid receptive layer receives the ink carrier liquid after passing through the upper fusible, porous layer where substantially all the colorant has been removed. The optional porous ink-carrier-liquid receptive layer receives the ink carrier liquid after the ink has passed through the porous ink-transporting layer and through the porous dye-trapping layer where substantially all the dye has been removed. The ink-carrier-liquid receptive layer can be any conventional porous structure. In a preferred embodiment, the ink-carrier-liquid receptive layer is present in an amount from about 1 $g/m^2$ to about 50 $g/m^2$, preferably from about 10 $g/m^2$ to about 45 $g/m^2$. The thickness of this layer may depend on whether a porous or non-porous support is used.

In general, the porous ink-carrier-liquid receptive layer will have a thickness of about 1 μm to about 50 μm, and an upper fusible, porous residing thereon will usually have a thickness of about 2 μm to about 50 μm.

In a preferred embodiment of the invention, the ink-carrier-liquid receptive layer is a continuous, co-extensive porous layer that contains organic or inorganic particles. Examples of organic particles which may be used include core/shell particles such as those disclosed in U.S. Pat. No. 6,492,006, issued Dec. 10, 2002 to Kapusniak et al., filed Jun. 30, 2000, and homogeneous particles such as those disclosed in U.S. Pat. No. 6,475,602, issued Nov. 05, 2002 to Kapusniak et al., filed Jun. 30, 2000, the disclosures of which are hereby incorporated by reference. Examples of organic particles that may be used in this layer include acrylic resins, styrenic resins, cellulose derivatives, polyvinyl resins, ethylene-allyl copolymers and polycondensation polymers such as polyesters.

Examples of inorganic particles that may be used in the ink-carrier-liquid receptive layer include silica, alumina, titanium dioxide, clay, calcium carbonate, calcium metasilicate, talc, barium sulfate, or zinc oxide.

In a preferred embodiment of the invention, the porous ink-carrier liquid receptive layer comprises from about 20% by weight to about 100% by weight of particles and from about 0% to about 80% by weight of a polymeric binder, preferably from about 80% by weight to about 95% by weight of particles and from about 20% by weight to about 5% by weight of a polymeric binder. In a preferred embodiment, the polymeric binder may be a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

In order to impart mechanical durability to the ink carrier-liquid receptive layer, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid and derivatives of boric acid, and the like may be used. Preferably, the crosslinker is an aldehyde, an acetal or a ketal, such as 2,3-dihydroxy-1,4-dioxane.

The porous ink-carrier-liquid receptive layer can also comprise an open-pore polyolefin, open-pore polyester or open-pore membrane. An open-pore membrane can be formed in accordance with the known technique of phase inversion. Examples of a porous ink-receiving layers comprising an open-pore membrane ate disclosed in U.S. Pat. No. 6,497,941 issued Dec. 24, 2002 and U.S. Pat. No. 6,503,607 issued Jan. 07, 2003, both of Landry-Coltrain et al., hereby incorporated by reference.

In a particularly preferred embodiment of the invention, the ink carrier-liquid receptive layer is a continuous, co-extensive porous calcium-metasilicate-containing base layer comprising calcium-metasilicate needles, and optionally organic and/or inorganic particles in a polymeric binder, the length of the calcium metasilicate being from 1 μm to 50 μm. Examples of calcium metasilicate that can be used in the invention include VANSIL acicular Wollastonite. Such a material can also be represented by the commonly used formula for calcium metasilicate or $CaSiO_3$. VANSIL WG, for example, is a high aspect ratio, long needle grade of Wollastonite. Other useful grades, depending on the particular inkjet recording system, include VANSIL HR-1500 and HR-325, which are all commercially available from R.T. Vanderbilt Co., Inc., Norwalk, Conn.

In one, the porous calcium-metasilicate-containing base layer comprises between 75% by weight and 95% by weight of particles and between about 5% and 25% by weight of a polymeric binder, preferably from about 82% by weight to about 92% by weight of particles and from about 18% by weight to about 8% by weight of a polymeric binder, most preferably about 10% by weight of binder. Preferably, the calcium-metasilicate-containing layer comprises at least 25 percent by weight of calcium-metasilicate particles. In one preferred embodiment, the ratio of the calcium-metasilicate needles to other organic or inorganic (substantially spherical) particles is about 30:70 to 70:30.

As mentioned above, a first embodiment of the invention involves an upper (preferably uppermost) fusible, porous layer that is designed to preferably function as a pigment-trapping upper layer, a second embodiment of the invention involves an upper (preferably uppermost) fusible, porous layer that is designed to preferably alternatively function as both a pigment-trapping layer and a dye-trapping layer, i.e., the printed image is formed in the upper fusible, porous layer irrespective of the ink composition, and in yet a third embodiment, the upper fusible, porous layer is designed to preferably function as an ink-transporting layer above a lower fusible, porous dye-trapping layer comprising fusible polymer particles (not necessarily crosslinkable), an optional dye mordant, and an optional hydrophilic binder.

In this third embodiment, the upper fusible, porous layer may, in addition, contain a film-forming hydrophobic binder, which may be advantageous in the case of a lower dye-trapping layer that is also fusible. The presence of a minor amount of binder may provide more pre-fusing raw-stock keeping, durability, and handling capability. The film-forming, hydrophobic binder useful in the invention can be any film-forming hydrophobic polymer capable of being dispersed in water. In a preferred embodiment of the invention, however, there is no binder. If a binder is used, it preferably should be used in a minor amount.

In the case of the upper fusible, porous layer designed to preferably function as an ink-transporting layer in combination with a fusible dye-trapping layer that receives the ink from the upper ink-transporting layer, the fusible dye-trapping layer preferably retains substantially all the dye, and can allow for the passage of the ink carrier liquid to an optional underlying porous ink-carrier-liquid-receptive layer and/or an optionally porous support.

Upon fusing, via the application of heat and/or pressure, the air-particle interfaces present in the original porous structure of the dye-trapping layer (also referred to as the image layer) are eliminated, and a non-scattering, substantially continuous layer forms which contains the printed image. It is an important feature of this embodiment of the invention that both the fusible, porous ink-transporting layer and the underlying dye-trapping layer be transformable into a non-scattering layer as this significantly raises image density.

The fusible, polymer particles employed in the dye-trapping layer of this embodiment of the invention typically range from about 0.1 μm to 10 μm, although smaller particles are possible. The particles employed in the dye-trapping layer may be formed from any polymer that is fusible, i.e., capable of being converted from discrete particles into a substantially continuous layer through the application of heat and/or pressure. In a preferred embodiment of the invention, the fusible, polymer particles comprise the ester derivative of a natural polymer, such as cellulose acetate butyrate, a step growth polymer, such as a polyester or a polyurethane or a chain, growth polymer, for example, a styrenic polymer, a vinyl polymer, an ethylene-vinyl chloride copolymer, a polyacrylate, poly(vinyl acetate), poly(vinylidene chloride), or a vinyl acetate-vinyl chloride copolymer, and the like.

The binder employed in the dye-trapping layer can be any film-forming polymer that serves to bind together the fusible polymer particles. In a preferred embodiment, the binder is a hydrophobic film-forming binder derived from an aqueous dispersion of an acrylic polymer, a vinyl acetate polymer or polyurethane.

A dye mordant is preferably employed in the dye-trapping layer. Such a dye mordant can be any material that is effectively substantive to the inkjet dyes. The dye mordant removes dyes from the ink received from the porous ink-transporting layer and fixes the dye within the dye-trapping layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; a copolymer of vinyl alcohol and vinyl amine or its quaternized ammonium analog; and hydroxyethylcellulose derivatized with 3-N,N,N-trimethylammonium)propyl chloride. In a preferred embodiment, the cationic mordant is a quaternary ammonium compound.

In order to be compatible with the mordant, both the binder and the polymer comprising the fusible particles is preferably either uncharged or the same charge as the mordant. Colloidal instability and unwanted aggregation could result if the polymer particles or the binder had a charge opposite from that of the mordant.

In one particular embodiment, the fusible particles in the dye-trapping layer may range from about 95 to about 60 parts by weight, the binder may range from about 40 to about 5 parts by weight, and the dye mordant may range from about 2 parts to about 40 parts by weight. More preferably, the dye-trapping layer comprises about 80 parts by weight fusible particles, about 10 parts by weight binder, and about 10 parts by weight dye mordant. The dye-trapping layer can be present in the recording element in an amount by weight of from about 1 $g/m^2$ to about 50 $g/m^2$, more preferably in an amount from about 1 $g/m^2$ to about 10 $g/m^2$.

The support used in the inkjet recording element of the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a polylactic acid, a fluorine resin such as poly(tetra-fluoro ethylene), metal foil, various glass materials, and the like. In a preferred embodiment, the support is an open-structure paper support as used in the Examples below. The thickness of the support employed in the invention can be from about 12 to about 500 μm, preferably from about 75 to about 300 μm.

If desired, in order to improve the adhesion of the base layer to the support, the surface of the support may be corona-discharge-treated prior to applying the base layer or solvent-absorbing layer to the support.

Since the inkjet recording element may come in contact with other image recording articles or the drive or transport mechanisms of image recording devices, additives such as surfactants; lubricants, matte particles and the like may be added to the element to the extent that they do not degrade the properties of interest.

Also, a backside coating may be coated on the opposite side of the support of the inkjet recording element to provide water and stain resistance, front to back thermal blocking resistance, acceptable raw stock keeping, and curl balance. A preferred coating to impart some or all of the characteristics just mentioned is a polymeric coating, such as polymer latex, containing dispersed hydrophobic polymer particles. Additionally, since this backside coating, like the front side coating, may come in contact with other image recording articles or the drive or transport mechanisms of image recording devices, additives such as surfactants, lubricants, inorganic particles to provide reinforcement, matte spacer particles and the like may be added to the coating to the extent that they do not degrade the properties of interest.

The layers described above, including the ink-carrier-liquid receptive layer and the upper fusible, porous layer, may be coated by conventional coating means onto a support material commonly used in this art. Depending on the embodiment, a dye-trapping layer and an ink-transporting layer may be similarly coated onto a support material. Coating methods may include, but are not limited to, wound wire rod coating air-knife coating, slot coating, slide hopper coating, gravure, curtain coating and the like. Some of these methods allow for simultaneous coatings of all three layers, which is preferred from a manufacturing economic perspective.

After printing on the element of the invention, the upper fusible, porous is heat and/or pressure fused to form a substantially continuous overcoat layer on the surface. Upon fusing, this layer is rendered non-light scattering. Fusing may be accomplished in any manner that is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference. If a fusing roller is used, it is advantageously facilitated by the low Tg reactive polymer particles of the present invention.

In a preferred embodiment, fusing is accomplished by contacting the surface of the element with a heat-fusing member, such as a fusing roller or fusing belt. Thus, for example, fusing can be accomplished by passing the element, with or without a release liner in contact with the fusible surface, through a pair of heated rollers, heated to a temperature of about 60° C. to about 160° C., using a pressure of 5 to about 15 MPa at a transport rate of about 0.005 m/sec to about 0.5 m/sec.

As mentioned above, lower initial Tg for the fusible polymer particles can be an advantage for fusing at relatively lower temperatures and/or lower pressures, for example less than about 300° F., instead of 350° F. as required for some prior art fusible polymer particles of a cellulose ester. Following fusing and crosslinking, a higher Tg for the top layer of the inkjet element is obtained so that blocking problems are avoided. Also, a further advantage of inkjet media that can be made in accordance with the present invention is that, since less heat may be required to fuse the element, the inkjet element can be released from the fusing element when relatively hot without deformation and without lowering gloss or adversely affecting a smooth surface. This facilitates the use of a fuser roller as compared to a belt fuser that may otherwise be needed to provide longer contact so that the inkjet element has sufficient time to cool before release.

Inkjet recording element according to the present invention can be printed with pigmented or dye-based inks, or mixtures thereof. Inkjet inks that can be used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

The following examples further illustrate the invention.

EXAMPLES

Polymer particle dispersion P-1 was prepared as follows. The particle size was measured by a MICROTRAC Ultra Fine Particle Analyzer (Leeds and Northrup) at a 50% median value.

Synthesis of Polymer Particles P-1

The polymer particle dispersion was prepared by an emulsion polymerization technique.

| | | |
|---|---|---|
| A: | Deionized water | (200 g) |
| | Potassium persufate | (0.3 g) |
| B: | Potassium persulfate | (0.8 g) |
| | ethyl methacrylate | (123.5 g) |
| | Methylacrylic acid | (6.5 g) |
| | Deionized water | (240 g) |
| | Mercaptan acid | (1.3 g) |

Part (A) was first charged to a 1L 3-neck flask equipped with a nitrogen inlet, mechanical stirrer and condenser. The flask was immersed in a constant temperature bath at 80° C. and purged with nitrogen for 20 min.

Part (B) was added to the mixture. Agitation was maintained all the time during the feeding of the monomer emulsion. The addition time of the monomer emulsion (B) was two hours.

The polymerization was continued for 30 min after the addition of the monomer emulsion. The mixture was cooled to room temperature and filtered. The final solids were about 22% and the final particle size was about 820 nm. The monodispersity was 1.02 as determined by UPA.

Synthesis of P-2 Polymer Particle Dispersions

The polymer particle dispersions were prepared by an emulsion polymerization technique.

| | | |
|---|---|---|
| A: | Deionized water | (100 g) |
| | Potassium persufate | (0.2 g) |
| B: | Potassium persulfate | (0.45 g) |
| | ethyl methacrylate | (45.5 g) |
| | butyl acrylate | (9.75 g) |
| | Methylacrylic acid | (9.75 g) |
| | Deionized water | (120 g) |
| | Mercaptan acid | (1.3 g) |

The same reaction procedure as for P-1 was repeated. The final solids were about 20 to 25% by weight and the final particle size was about 820 nm. The monodispersity was 1.03 as determined by UPA. Such particle dispersions can be reacted, in a fusible top layer, with, in an adjacent layer, polyfunctional compounds having oxazoline or epoxy complementary reactive functionalities, for example, a polyhydroxyalcan polyglycidylether functional polymer (CR-5L from Esprix Technologies) or oxazoline functional copolymer (WS500 from Esprix Technologies).

Synthesis of P-3 Polymer Particle Dispersions

The polymer particle dispersions were prepared the same way as the above samples except that butyl acrylate was replaced with butyl methacrylate and there was no mercaptan acid in the recipe. Since mercaptan acid is a chain transfer agent that controls molecular weight, its absence results in a higher molecular weight than previous examples. The final solids were about 22% by weight, and the final particle size was about 820 μm. The monodispersity was 1.03 as determined by UPA. Such particle dispersions can be reacted, in a fusible top layer, with polyfunctional compounds, in an adjacent layer, having oxazoline or epoxy complementary reactive functionalities, for example, polyhydroxyalcan polyglycidylether functional polymer (CR-5L from Esprix Technologies) or oxazoline functional copolymer (WS500 from Esprix Technologies).

Synthesis of P-4 Polymer Particle Dispersions

The polymer particle dispersions were prepared the same way as for the P-1 and P-2 samples except that the monomer composition was: ethyl methacrylate 55.25 g, hydroxyethyl methacrylate 3.25 g, and butyl methacrylate 6.5 g. The final solids were about 22% by weight, and the final particle size was about 820 nm. The monodispersity was 1.02 as determined by UPA. Such particle dispersions can be reacted, in a fusible top layer, with polyfunctional compounds, in an adjacent layer, having epoxy or oxazoline complementary reactive functionalities, for example, polyhydroxyalcan polyglycidylether functional polymer (CR-5L from Esprix Technologies) or oxazoline functional copolymer (WS500 from Esprix Technologies).

Synthesis of P-5 Polymer Particle Dispersions

The polymer particle dispersions were prepared the same way as the above P-1 and P-2 samples except that the monomer composition was: ethyl methacrylate 54.2 g, and dimethyl aminoethyl methacrylate 10.8 g. The final solids were about 22% by weight, and the final particle size was about 820 nm. The monodispersity was 1.03 as determined by UPA. Such particle dispersions can be reacted, in a fusible top layer, with polyfunctional compounds, in an adjacent layer, having acetoacetoxy complementary reactive functionalities.

Synthesis of P-6 Polymer Particle Dispersions

The polymer particle dispersions were prepared the same way as the above P-1 and P-2 samples except that the monomer composition was: ethyl methacrylate 54.2 g and acetoacetoxylethyl methacrylate 10.8 g. The final solids were about 22% by weight, and the final particle size was about 520 nm. The monodispersity was 1.04 as determined by UPA. Such particle dispersions can be reacted, in a fusible top layer, with polyfunctional compounds, in an adjacent layer, having amino complementary reactive functionalities, which polyfunctional compounds can diffuse into the fusible top layer.

Synthesis of P-7 Polymer Particle Dispersions

The polymer particles were prepared the same way as above P-1 and P-2 samples except the monomer composition was: ethyl methacrylate 45.5 g, methyl methacrylate 13.0 g and methacrylic acid 6.5 g; and also with chain transfer agent butyl mercaptan 0.65 g. The final solids were about 22% by weight, and the final particle size was about 820 nm. The monodispersity was 1.03 as determined by UPA. Such particle dispersions can be reacted, in a fusible top layer, with polyfunctional compounds, in an adjacent layer, having epoxy or oxazoline complementary reactive functionalities, for example, polyhydroxyalcan polyglycidylether functional polymer:(CR-5L from Esprix Technologies) or oxazoline functional copolymer (WS500 from Esprix Technologies).

Synthesis of P-8 Polymer Particle Dispersions

The polymer particle dispersions were prepared the same way as above P-1 and P-2 samples except the monomer composition was: ethyl methacrylate 59.6 g and glycidyl methacrylate 5.4 g. The final solids were about 22% by weight, and the final particle size was about 380 nm. The monodispersity was 1.10 as determined by UPA. Such particle dispersions can be reacted, in a fusible top layer, with polyfunctional compounds, in an adjacent layer, having carboxylic acid complementary reactive functionalities, which polyfunctional compounds can diffuse into the fusible top layer.

Various inkjet recording elements according were prepared as follows:

Example 1

A 25% solids aqueous solution was made containing calcium metasilicate (HR325 WOLLASTONITE from R.T. Vanderbilt Company Inc., Norwalk, Conn.), plastic pigment latex (HS3000 NA high-Tg acrylic hollow beads (1 μm), from Dow Chemical, Marietta, Ga.), and polyvinyl alcohol (GH17 GOHSENOL from Nippon Gohsei, Osaka, Japan) at a dry weight ratio of 45/45/10. This was then coated and dried at a dry laydown of 26.9 g/m$^2$ (2.5 g/ft$^2$) on DOMTAR QUANTUM 80 paper using a hopper coater to provide an ink-carrier-liquid-receptive layer on a support.

Example 2

Dispersion P-1 was diluted to make an 18% aqueous dispersion. This was then coated over the ink-carrier-liquid receptive layer of Example 1 at a dry laydown of 8.6 g/m$^2$ (0.8 g/sqft) and dried to form a comparative recording element, comprising a fusible porous layer comprising thermoplastic polymer particles without cross-linking capability.

Example3

A 10% aqueous solution of an oxazoline functional copolymer (WS500 from Esprix Technologies) was coated over the coating of Example 2 at a dry laydown of 0.4 grams/sq ft (4 grams/m$^2$) and dried to form a comparative recording element.

Example 4

A 10% aqueous solution of an oxazoline functional copolymer (WS500 from Esprix Technologies) was coated over the ink-carrier-liquid-receptive layer of Example 1 at a dry laydown of 0.4 grams/sq ft (4 grams/m$^2$) and dried.

Example 5

A polymeric particle dispersion P-1 was diluted to make an 18% aqueous solution. This was then coated over the coating of Example 4 at a dry laydown of 0.8 g/sq ft (8 grams/m$^2$) and dried to form a recording element according to the present invention.

Printing

Example recording elements 2, 3, and 5 were printed with a CANON i550 inkjet printer with EASTMAN KODAK pigment inks, with a test target comprised of 1 cm$^2$ color patches, a set of each of the primary and secondary colors. Each patch was printed at 100% density.

Fusing and Testing

The printed elements were allowed to dry for 1 hour and then were fused in a heated nip at 125° C. and 4.2 kg/cm$^2$ against a sol-gel coated polyimide belt at 76 cm/min. Separate drops of water, coffee, and fruit punch (HAWAIIAN PUNCH, which contains Red Dye #40 and Blue Dye #1) were placed on the color patches and a white non-printed area and allowed to set for 10 minutes and then blotted off. Each area where a drop was placed was visually inspected for any stain, watermarks, and deformations to the surfaces. If any stain, watermark, or deformation was detected it was assigned a failing grade. If no stain, watermark or deformation was seen it was assigned a passing grade. Table 1 summarizes the results:

TABLE 1

| Example | Base Layer | Mid Layer | Top Layer | Stain Test Result |
|---|---|---|---|---|
| Comparison 2 | Example 1 | None | P-1 Reactive Particles | Fail |
| Comparison 3 | Example 1 | P-1 Reactive Particles | Diffusible Crosslinker | Fail |
| Example 5 | Example 1 | Diffusible Crosslinker | P-1 Reactive Particles | Pass |

The data clearly shows that a recording element in which a crosslinking agent is present in the mild layer and a reactive fusible polymer in the topmost layer provides excellent stain resistance after fusing. When the crosslinking agent is present in the top most layer and the reactive particles are in the mid layer or if the crosslinker is not present, the stain resistance is poor.

The invention has been described with reference to a preferred embodiment. However, it will be appreciated that variations and modifications can be effected by a person of ordinary skill in the art without departing from the scope of the invention.

The invention claimed is:

1. An inkjet printing method, comprising the steps of:

A. providing an inkjet printer that is responsive to digital data signals;

B. loading the printer with an inkjet recording element comprising a support having in relative order thereon:

(a) an upper fusible, porous layer comprising fusible reactive polymeric particles that comprise a thermoplastic polymer having reactive functionalities, and (b) a lower crosslinker-containing second layer comprising a polyfunctional compound having complementary reactive functionalities capable of crosslinking the reactive functionalities on the thermoplastic polymer of the upper fusible porous layer when subjected to fusing;

C. loading the printer with an inkjet ink composition;

D. printing on the inkjet recording element using the inkjet ink composition in response to the digital data signals; and E. fusing at least the upper fusible, porous layer to render the layer non-porous.

2. The method of claim 1, wherein the thermoplastic polymer in the fusible reactive polymeric particles comprises monomeric units having reactive functionalities selected from the group consisting of oxazoline, epoxy, acid, anhydride, acetoacetoxy, primary or secondary amine, hydroxyl, phenol, thiol, and isocyanate functionalities, and wherein the polyfunctional compound has complementary reactive functionalities along a polymer chain, the complementary reactive functionalities selected from the same group.

3. The method of claim 1, wherein the polyfunctional compound comprises 0.1 to 100 mole percent of monomeric units having the complementary reactive functionalities and 0 to 99.9 mole percent of monomeric units that are derived from non-reactive monomers.

4. The method of claim 1, wherein the polyfunctional compound comprises 5 to 50 percent of monomeric units derived from functionally reactive monomers selected from the group consisting of epoxy and oxazoline monomers.

5. The method of claim 1, wherein the polyfunctional compound is an epoxy-functional polymer, and the thermoplastic polymer is an acid-functional, hydroxy-functional, amine-functional, or anhydride functional polymer.

6. The method of claim 1, wherein the polyfunctional compound is an oxazoline-functional polymer, and the thermoplastic polymer is an acid-functional, anhydride-functional, phenol-functional, or thiol-functional polymer.

7. The method of claim 1, wherein the upper fusible, porous layer is an uppermost porous layer in the inkjet recording element.

8. The method of claim 1, further comprising an ink-carrier-liquid receptive layer between the support and the upper fusible, porous layer.

9. The method of claim 1, wherein the number average molecular weight of the thermoplastic polymer is from 5,000 to 1,000,000 and the glass transition temperature is above about 20 C. and less than about 100° C.

10. The method of claim 1, wherein the thermoplastic polymer comprises a step growth polymer selected from the group consisting of polyester and polyurethane, a derivative of cellulose or other natural polymer, or a chain growth polymer selected from the group consisting of a styrenic polymer, vinyl polymer, ethylene-vinyl chloride copolymer, acrylic polymer, poly(vinyl acetate), poly(vinylidene chloride), vinyl acetate-vinyl chloride copolymer, and copolymers thereof.

11. The method of claim 1, wherein the thermoplastic polymer comprises a polyacrylate polymer or copolymer comprising one or more monomeric units derived from an alkyl acrylate or an alkyl methacrylate monomer, wherein the alkyl group has 1 to 10 carbon atoms.

12. The method of claim 1, wherein the thermoplastic polymer comprises a first monomeric unit having a reactive functionality selected from the group consisting of oxazoline, epoxy, acid, anhydride, acetoacetoxy, primary or secondary amine, hydroxyl, phenol, thiol, and isocyanate functionalities, and wherein the polyfunctional compound comprises a second monomeric unit having a complementary reactive functionality, the complementary reactive functionality being selected from the same group, such that the reactive functionality and the complementary reactive functionality are capable of crosslinking.

13. The method of claim 1, wherein the thermoplastic polymer comprises an acid-functional, hydroxy-functional, amine-functional, or acid-anhydride functional group.

14. The method of claim 1, wherein the thermoplastic polymer and the polyfunctional compound, respectively, comprise a hydroxy group and an epoxy group.

15. The method of claim 1, wherein the thermoplastic polymer and the polyfunctional compound, respectively, comprise a hydroxy group and carboxylic acid group.

16. The method of claim 1, wherein the thermoplastic polymer and the polyfunctional compound, respectively, comprise an oxazoline group and carboxylic acid group.

17. The method of claim 1, wherein the thermoplastic polymer and the polyfunctional compound, respectively, comprise a carboxylic acid group and a complementary crosslinking group.

18. The method of claim 1, wherein the thermoplastic polymer and the polyfunctional compound, respectively, comprise an acetoacetoxy and amine functionality.

19. The method of claim 1, wherein the inkjet recording element further comprises a lower fusible, porous layer between the upper fusible, porous layer and the support that is a dye-trapping layer comprising fusible polymer particles, a dye mordant, and an optional binder and, between the dye-trapping layer and the support, an optional ink-carrier-liquid receptive layer.

20. The method of claim 19, wherein the dye mordant comprises a quaternary ammonium compound.

21. The method of claim 19, wherein the inkjet ink composition is a dye-based ink and further comprising simultaneously fusing the lower fusible porous layer, functioning as a dye-trapping layer, and the upper fusible, porous layer, functioning as an ink-transporting layer, such that both layers are non-porous.

* * * * *